United States Patent [19]

van der Eijk et al.

[11] Patent Number: 4,874,987

[45] Date of Patent: Oct. 17, 1989

[54] MODULAR X-RAY IMAGE INTENSIFIER TUBE

[75] Inventors: Bart van der Eijk; Johannes N. van de Wiel; Engelbertus Rongen, all of Heerlen; Christiaan J. G. H. Wulms, Eindhoven, all of Netherlands

[73] Assignee: U.S. Philips Corporation, New York, N.Y.

[21] Appl. No.: 91,680

[22] Filed: Aug. 31, 1987

[30] Foreign Application Priority Data

Sep. 2, 1986 [NL] Netherlands ..... 8602212

[51] Int. Cl.[4] ..... H01J 35/16; H01J 43/28

[52] U.S. Cl. ..... 313/525; 313/544; 313/553; 220/2.1 R

[58] Field of Search ..... 313/525, 542, 544, 553, 313/559, 529, 537; 250/213 T; 350/96.1, 96.15, 96.18, 96.27; 417/48, 49; 220/2.1 R, 2.2, 2.3 R

[56] References Cited

U.S. PATENT DOCUMENTS 4,763,042 8/1988 Colomb et al. ..... 313/544

*Primary Examiner*—Kenneth Wieder

[57] ABSTRACT

An X-ray image intensifier tube is constructed as a modulator system using modules which are uniform for as many different types of tube as possible. Whenever feasible, the modules are detachably combined so as to form one unit.

16 Claims, 1 Drawing Sheet

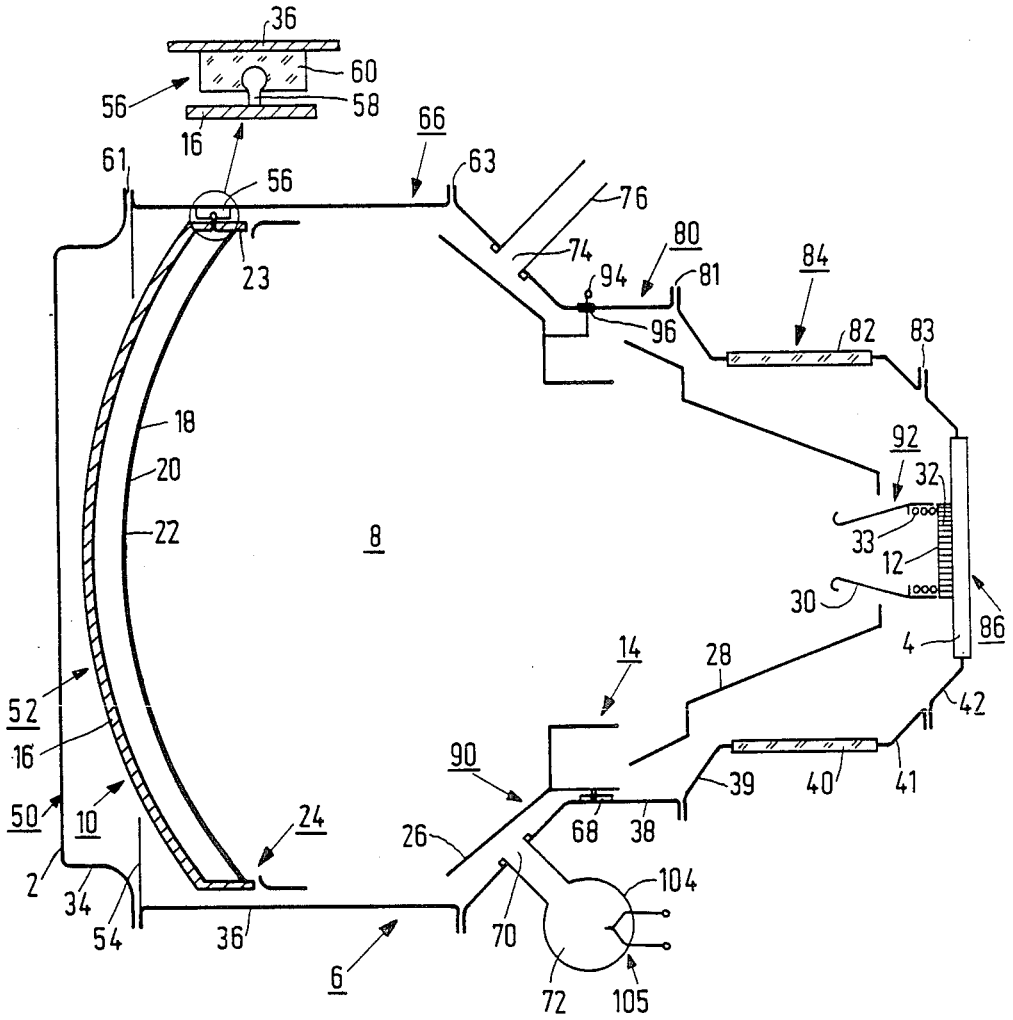
36
60
56
58
16
66
61
56
63
76
74
80
94
81
84
23
96
82
83
18
92
20
32
22
8
33
12
30
86
4
14
28
52
42
16
90
39
40
41
50
10
24
26
68
38
2
104
34
54
36
70
6
72
105

MODULAR X-RAY IMAGE INTENSIFIER TUBE

BACKGROUND OF THE INVENTION

The invention relates to an X-ray image intensifier tube, comprising an entrance window and an exit window which enclose, in conjunction with a cylindrical jacket, an evacuated space in which there are arranged an entrance screen, an exit screen, and an electron-optical imaging system.

An X-ray image intensifier tube of this kind is known from U.S. Pat. No. 4,213,055. In medical diagnostics a strong need exists for more different types of X-ray image intensifier tubes, for example, for more different dimensions of the entrance screen.

For, a long time the availability of only two entrance screen dimensions has been accepted, that is to say approximately 15 cm and approximately 25 cm. At an early stage a 25 cm tube was made suitable for imaging a 15 cm entrance screen by means of an electron-optical zoom system. More recently, the need has arisen for an X-ray image intensifier tube having a larger entrance screen, for which purpose the 35 cm tube described in U.S. Pat. No. 4,213,055 has been developed. Even though this tube also comprises an optical zoom system, that is to say for the dimensions 15, 25 and 35 cm of the entrance screen, there still is a need for, for example, a 30 cm tube and also for comparatively inexpensive tubes comprising smaller entrance screens. Specific diagnostic methods have also given rise to specific demands as regards the entrance screen and whether or not to use a fibre-optical system for the exit window, as regards the resolution of the screens, etc. This again results in specifications which cannot always be combined in a single window or screen, so that even more types of tubes are desired.

Wishes as regards electron-optical properties may also give rise to solutions which cannot be implemented in a single electrode system.

The manufacture of X-ray image intensifier tubes where each type of tube customarily treated as a separate product during the entire production process becomes less efficient as the number of types increases. It has also been found that excessive construction tolerances must be accepted in the production of notably high-quality X-ray image intensifier tubes.

SUMMARY OF THE INVENTION

In an X-ray image intensifier tube in accordance with the invention a number of components which are the same for different types of tube constitute modules of a modular construction system.

By using an indentical construction for components having an identical function, a modular production system is obtained where the total number of different components for the entire range of tubes is minimized. As a result, full attention can be paid to each component, its quality can be optimized, and the number of components to be stored can be substantially reduced. For example, an entrance screen, an entrance window, a first jacket portion, an electrode system or a part thereof, an exit window, an exit screen, and a further jacket portion etc. can form modules. In a preferred embodiment, for the mounting of electrodes for the electron-optical system on a jacket portion use is made of detachable, suitably reproducibly connectable connections so that the one and the same jacket portion can be used for different electrode systems. The lens as well as the wall portion as well as the two parts together can form a module, even though they are detachably combined. The cylindrical jacket in a preferred embodiment comprises, also for the mounting of different electrodes, an entrance window supporting bush, a sealing bush, a conical intermediate bush, an insulating bush which is arranged between two auxiliary bushes, and an exit window supporting bush. In a preferred embodiment, a getter ion pump is mounted on a conical jacket portion, a jacket portion thereof forming a magnetic yoke for permanent magnets to be connected to ends thereof. To the conical jacket portion there may also be connected an exhaust tube and a dispenser for the formation of a photo cathode. The connection tubes are preferably constructed so that they can be sealed vacuum-tight by cold deformation, without producing loose particles and without the release of gas. To this end, use can be made of tubes made of a metal which is not excessively cold so that it can be squeezed tight reasonably well, for example, copper or indium.

In a further preferred embodiment, an exit screen is resiliently mounted between an anode bush and an electron-optical imaging system, so that the exit window can be exactly adjusted and optimum electrode positioning can be achieved. To this end, the electron-optical system in a further embodiment is adapted to generate a comparatively high field strength near the photocathode surface of the entrance screen. Thus, a more reliable unipotential field is obtained as the cathode for the electron-optical system. A compromise can then be chosen so that during a mode of operation where the most severe requirements are imposed as regards the resolution the cathode potential is optimum. The homogeneity of the photocathode surface can be increased, for example, by performing a finishing operation on the adjoining surface of the luminescent layer which conventionally has a rather coarse morphology. Such a finishing operation may be a mechanical operation where projections are pushed aside and cavities are filled, for example by using a pressing or screening process. The finishing operation may also be a thermal operation, for example briefly heating the surface to the yield point of the luminescent material. Alternatively, a denser packing can be imparted to a final layer of the luminescent layer by way of an adapted deposition technique. This can be realized by hot deposition, by flame or plasma spraying etc. of the last luminescent material. Such an operation is preferably performed only after the known crackled structure has been imparted to the luminescent layer.

BRIEF DESCRIPTION OF THE DRAWING

The sole FIGURE is a section view of an X-ray image intensifier tube in accordance with the invention.

DETAILED DESCRIPTION OF THE PREFERRED EMBODIMENT

An X-ray image intensifier tube as shown in the FIGURE comprises an entrance window 2, an exit window 4, and a cylindrical jacket 6 which together enclose an evacuated space 8. The space 8 accommodates an entrance screen 10, an exit screen 12 and an electron-optical imaging system 14. The entrance screen of the tube is in this case formed by a separate foil and is made of, for example ion, glassy carbon or aluminium; however, for many applications it is preferably made of titanium. Even for tubes having a large entrance window, the titanium entrance window need not be thicker than, for example approximately 0.2 mm, so that therein the scattering of an X-ray beam to be detected is only slight. Because the window does not act as a support for an entrance window, some deformation, for example due to the evacuation of the tube, is permissible. The entrance screen comprises a hollow support 16 which is preferably made of aluminum and which may also be thin because it does not act as a vacuum wall. On the support there is provided a layer of luminescent material 18 and thereon there is provided a photocathode 22, possibly with an intermediate separating layer 20. The entrance screen 10 in conjunction with a screening ring 23 forms, a first electrode 24 of the electron-optical imaging system which also includes a focussing electrode 26, a first anode 28 and a second anode 30. The second anode 30 may be constructed as separate electrode, but may also form, from an electron-optical point of view, one electrode with the exit screen 12. The exit screen 12 is arranged on a fibre-optic plate 32 which does not form the exit window of the intensified tube but serves only as a support for the exit screen in this case. The window plate 32 of the present embodiment is mounted in the anode bush 30 by way of a resilient element 33 and is present thereagainst by the exit window 4 upon assembly. However, the exit window 4 can alternatively be constructed as a fibre-optic plate, the exit screen 12 being arranged directly on the inner side thereof. The envelope jacket 6 has a circular cross-section in the present embodiment but may also be rectangular like the exit window 4, the entrance window 2 and possibly the exit screen 12 and the exit window 4, the jacket 6 includes an entrance window support 34, a sealing ring 36, an intermediate ring 38 which is constructed so as to be conical in the present embodiment, an insulating ring 40 which is mounted between a first mounting ring 39 and a second mounting ring 41 which are made of, for example stainless steel, and an exit window support 42. Using the intermediate ring 38, possibly in conjunction with at least one of the mounting rings 39, 41, any transition in diameter can be realized. A circular cylinder having a diameter which is the same for all rings is feasible for intensifier tubes having a comparatively small diameter as is a diameter transition with a circular cross-section for all rings. A rectangular cross-section and possibly a transition from a rectangular cross-section to a circular cross-section or vice versa are also feasible. Inter alia the following modules can be formed for a modular mounting system for the tube: The entrance window 2; with the entrance screen support 34 as the entrance window module 50. This module may be the same for all tubes having the same entrance screen format. The entrance screen 10, possibly with the screening ring 23, as the entrance screen module 52. Outside the electron-optical imaging field, this module may be provided with rings 54 for forming a spot catcher as described in U.S. Pat. No. 4,584,468 and mounting elements 56 for mounting the entrance screen module in the tube. For mounting use is made of a snap connection 58 with an insulator 60 which is connected to the sealing ring 36. The sealing ring 36 with weld ends 61 and 63 and the mounting elements 56 for the entrance screen module 52 as the jacket module 66. The intermediate ring 38; with in this case mounting elements 68 for the focussing electrode 26, a connection aperture 70 for a getter ion pump 72, and a connection aperture 74 for an exhaust tube 76, as the cone module 80. The insulator ring 40 with the mounting rings 39, 41 and weld ends 81 and 83 as the insulator module 84. The exit window 4 with the exit window support 42 as the exit module 86. The focussing anode 26 with mounting means 68 as the focussing module 90. The exit screen 12 with the support 32 and a final anode, if any, as the exit screen module 92.

The entrance window module 50 determines the format of the tube and the nature of the entrance window 2. For the entrance window material customarily titanium is used, notably for tubes having a comparatively large format, so that actually the number of different entrance window modules is determined by the tube format, the diameter as well as the geometry for circular as well as rectangular entrance windows being feasible variables. The entrance screen module 52 directly determines the tube format; further variables may be the thickness and the structure or construction of the luminescent layer. For many screens of the same format, however, an identical luminescent layer can be used. A difference in the luminescent layer and/or the photocathode, however, does not change the composition and construction of the module so that, using one and the same module, screens having different radiation conversion properties can be realized. For mounting the screen module 52 in the tube, the module has three resilient connections 56 with cams 58 for a snap-action connection.

The jacket module 66 comprises the described insulating elements for the mounting of the entrance screen module and may be identical for all tubes having the same entrance screen format. Dimensions of the cone module 80 are determined on the one hand by the dimensions of the jacket module due to the necessary vacuumtight joint 63 thereto, and possibly on the other hand by the geometry of the insulating module 84 with the likewise vacuumtight joint 81. The difference in cross-section between the two adjoining modules is then neutralized by the cone module.

In the embodiment shown, the getter ion pump 72 is mounted on the cone module 80. This pump is preferably constructed so that a cylinder wall 104 thereof acts as a magnetic closing yoke for permanent magnets (not shown) mounted on cylindrical end faces 105 thereof. As a result, disturbing effects of the magnetic field on the electron-optical image are avoided. In many tube formats it can be ensured that the getter ion pump 72 does not project from the jacket module. Furthermore, a dispersion device can be mounted on the cone module 80 by a connection tube similar to the connection tube 104. The dispersion device serves for the formation of the photocathode on, for example a vapour-deposited layer of CsI as the luminescent layer. To this end, at that area the anode may be provided with a dispersion aperture and a dispersion diaphragm may be arranged on an inner side of the cone module, opposite the connection tube 104. In order to avoid disturbing effects of the dispersion aperture in the imaging field, the aperture may be closed by means of a gauze. The connection tube 76 is preferably constructed as a pinching tube so that the tube can be closed after use without the risk of loose particles. The tube 76 may be constructed, as a cold sealable metal tube. For the sake of simplicity, the known connection for the dispersion device is not shown. The focussing anode may also be mounted so that the apertures therein are not situated behind the tube aperture. In order to prevent the ingress of light from the getter ion pump 72, a cover plate may be arranged opposite the aperture 70. The insulation module 84 may be identical for many types of tube and does not comprise further mounting parts in the embodiment shown here. When the desired cross-sectional transition is realized fully by the cone module 80, a single insulation module suffices in the case of an exit window module having the same cross-section. The insulation module serves not only for closing the vacuum space 8, but notably also for electrically separating an exit section of the tube from an entrance section thereof. A potential difference of, for example, 35 kV is applied between the two sections. The dimension of the focussing module 90 is closely related to the entrance screen format, but for different entrance screen formats an identical focussing module can still be used if so permitted by the entire electron-optical system. A difference in the nature of the entrance screen 10 has no effect on the focussing module, while the exit section thereof is the same for many types of tubes, at least as far as the geometry is concerned. The focussing module 90 is suspended in the cone module 80 in a customary manner by means of, for example three snap connections 68 so that it can be comparatively readily exchanged, like the entrance screen module 52, without the positioning precision being lost. The focussing module may also comprise the already mentioned dispersion gauze and, for example a titanium getter holder and an antimony holder. For the application of the appropriate potentials to the electrodes, the electrodes comprise, for example connection pins, such as the pin 94, which can be accessed by insulated passages 96 in the tube wall.

What is claimed is:

1. An x-ray image intensifier tube of the type comprising an evacuated space having therein an entrance screen, an exit screen, and an electron-optical imaging system, said tube further comprising modules as follows:

an entrance window module, a jacket module fixed to said entrance window module, a cone module comprising a conical intermediate ring fixed to said jacket module, said cone module constricting the cross section of said space away from said jacket module, an exit module, and an insulator module comprising a first sealing ring, a second sealing ring, and an insulating ring therebetween, said first sealing ring being fixed to said cone module, said exit module being fixed to said second sealing ring.

2. An x-ray image intensifier tube as in claim 1 wherein at least one of said first and second sealing rings further constricts the cross section of said space away from said cone module.

3. An x-ray image intensifier tube as in claim 1 wherein said imaging system comprises a focussing module, said focussing module comprising a focussing anode and mounting means for mounting said anode to said cone module.

4. An x-ray image intensifier tube as in claim 3 wherein said mounting means comprises a detachable and reproducible connectable resilient cam connection.

5. An x-ray image intensifier tube as in claim 1 wherein said entrance window module comprises a metal entrance window and a metal entrance window support.

6. An x-ray image intensifier tube as in claim 1 further comprising an entrance screen module comprising said entrance screen, a screening ring, and mounting means for mounting said screening ring to said jacket module.

7. An x-ray image intensifier tube as in claim 6 wherein said mounting means comprises a detachable and reproducible connectable resilient cam connection.

8. An x-ray image intensifier tube as in claim 1 wherein said exit module comprises an exit window and an exit window support.

9. An x-ray image intensifier tube as in claim 1 further comprising an exit screen module comprising said exit screen and a fiber optic plate which supports said exit screen.

10. An x-ray image intensifier tube as in claim 9 wherein said exit screen module further comprises an anode.

11. An x-ray image intensifier tube as in claim 10 further comprising an anode bush, said fiber optic plate being resiliently mounted between said anode bush and said exit window.

12. An x-ray image intensifier tube as in claim 1 wherein said cone module further comprises a getter ion pump having a magnetic yoke which is integral with said conical intermediate ring.

13. An x-ray image intensifier tube as in claim 1 wherein said cone module comprises an exhaust tube which is attached to said intermediate ring by pinching to form a vacuum-tight connection.

14. An x-ray image intensifier tube of the type comprising an evacuated space having therein an entrance screen, and exit screen and an electron-optical imaging system, said tube further comprising modules as follows:

an entrance window module, a jacket module fixed to said entrance window module, a cone module comprising a conical intermediate ring fixed to said jacket module, said cone module constricting the cross section of said space away from said jacket module, an exit module, and an exit screen module comprising said exit screen and a fiber optic plate which supports said exit screen.

15. An x-ray image intensifier tube of the type comprising an evacuated space having therein an entrance screen, and exit screen, and an electron-optical imaging system, said tube further comprising modules as follows:

an entrance window module, a jacket module fixed to said entrance window module, a cone module comprising a conical intermediate ring fixed to said jacket module, said cone module constricting the cross section of said space away from said jacket module, and an exit module, wherein said cone module further comprises a getter ion pump having a magnetic yoke which is integral with said conical intermediate ring.

16. An x-ray image intensifier tube of the type comprising an evacuated space having therein an entrance screen, and exit screen, and an electron-optical imaging system, said tube further comprising modules as follows:

an entrance window module, a jacket module fixed to said entrance window module, a cone module comprising a conical intermediate ring fixed to said jacket module, said cone module constricting the cross section of said space away from said jacket module, and an exit module, wherein said cone module comprises an exhaust tube which is attached to said intermediate ring by pinching to form a vacuum-tight connection.

* * * * *